US009657935B2

(12) United States Patent
Wilson

(10) Patent No.: US 9,657,935 B2
(45) Date of Patent: May 23, 2017

(54) WEARABLE DEVICES WITH INTEGRATED LIGHT SOURCES

(71) Applicant: Benjamin M. Wilson, St. Paul, MN (US)

(72) Inventor: Benjamin M. Wilson, St. Paul, MN (US)

(73) Assignee: Benjamin Michael Wilson, St. Paul, MN (US)

( * ) Notice: Subject to any disclaimer, the term of this patent is extended or adjusted under 35 U.S.C. 154(b) by 349 days.

(21) Appl. No.: 14/285,757

(22) Filed: May 23, 2014

(65) Prior Publication Data

US 2015/0016093 A1 Jan. 15, 2015

Related U.S. Application Data

(60) Provisional application No. 61/845,530, filed on Jul. 12, 2013.

(51) Int. Cl.
*F21V 21/08* (2006.01)
*F21V 33/00* (2006.01)
(Continued)

(52) U.S. Cl.
CPC ..... *F21V 33/0008* (2013.01); *A41D 19/0024* (2013.01); *F21V 33/0076* (2013.01);
(Continued)

(58) Field of Classification Search
CPC ..... A41D 13/01; A41D 19/0157; A41D 19/0024; A41D 19/00; A41D 19/0031; A41D 27/085; A42B 3/044; A42B 3/0446; A42B 3/0453; A42B 3/001; F21L 4/005; F21V 33/0004; F21V 33/0008; F21V 33/0076; F21W 2131/20; F21W 2131/202;
(Continued)

(56) References Cited

U.S. PATENT DOCUMENTS 5,535,105 A 7/1996 Koenen et al.
5,580,154 A 12/1996 Coulter et al.
(Continued)

OTHER PUBLICATIONS

Aerosafe "LED Aircraft Marshalling Safety Wands," [online], http://www.aerosafe.com/aircraft-marshalling-wands, 2012, [retrieved Jul. 16, 2014], retrieved from http://www.aerosafe.com/aircraft-marshalling-wands2 pages.
(Continued)

*Primary Examiner* — Diane Lee
*Assistant Examiner* — Omar Rojas Cadima

(57) ABSTRACT

In another implementation, a signaling apparatus includes a glove that is configured to be worn on a hand of a user; a first light source that extends along and is affixed to at least a portion of a lateral side of the glove, the lateral side of the glove corresponding to a lateral side of the user's hand that includes, at least, the user's fifth digit, fifth metacarpal, and ulna bone; and a second light source that extends along and is affixed to at least a portion of a medial side of the glove, the medial side of the glove corresponding to a medial side of the user's hand that includes, at least, the user's radial bone and one or more of: (i) the user's first metacarpal and first digit, and (ii) the user's second metacarpal and second digit.

17 Claims, 9 Drawing Sheets

(51) Int. Cl.

| | |
|---|---|
| ***A41D 19/00*** | (2006.01) |
| *F21W 111/06* | (2006.01) |
| *F21W 111/10* | (2006.01) |
| *F21Y 105/00* | (2016.01) |
| *F21Y 115/10* | (2016.01) |

(52) U.S. Cl.
CPC ..... *F21W 2111/06* (2013.01); *F21W 2111/10* (2013.01); *F21Y 2105/00* (2013.01); *F21Y 2115/10* (2016.08)

(58) Field of Classification Search
CPC ..... F21W 2131/30; F21W 2111/06; F21W 2111/10; G08B 5/004; F21Y 2101/00; F21Y 2105/00
USPC ..... 362/103
See application file for complete search history.

(56) References Cited

U.S. PATENT DOCUMENTS

| | | | | |
|---|---|---|---|---|
| 6,006,357 | A | 12/1999 | Mead | |
| 6,709,142 | B2 | 3/2004 | Gyori | |
| 6,711,746 | B1 | 3/2004 | Orellana | |
| 6,892,397 | B2 | 5/2005 | Raz et al. | |
| 7,013,490 | B2 | 3/2006 | Senter et al. | |
| 7,399,099 | B2 * | 7/2008 | Stokes | G08B 5/006 2/160 |
| 7,503,667 | B2 | 3/2009 | Wilkings | |
| 7,959,314 | B1 | 6/2011 | Rodriguez | |
| 8,376,565 | B2 * | 2/2013 | Schrimmer | A41D 19/0157 362/103 |
| 2008/0062676 | A1 * | 3/2008 | Masuda | A41D 19/0024 362/103 |
| 2008/0218996 | A1 | 9/2008 | Galloway et al. | |
| 2010/0238650 | A1 * | 9/2010 | Haney | A63C 3/00 362/103 |
| 2013/0201672 | A1 * | 8/2013 | Bushee | F21V 15/04 362/190 |

OTHER PUBLICATIONS

Aerosafe, "AeroSaft's Aircraft Marshalling Wands," [online], http://www.aerosafe.com/AeroSafes-Aircraft-Marshalling-Wands_b_15.html, 2012, [retrieved Jul. 16, 2014], retrieved from http://www.aerosafe.com/AeroSafes-Aircraft-Marshalling-Wands_b_15.html. 2 pages.

Choi, et al., "Visual Recognition of Aircraft Marshalling Signals Using Gesture Phase Analysis," [online] http://cvpr.yonsei.ac.kr/publication/papers/inco/Visual%20recognition%20of%20aircraft%20marshalling%20signals%20using%20gesture%20phase%20analysis.pdf, 2008 OEEE Intelligent Vehicles Symposium, Eindhoven, The Netherlands, Jun. 4-6, 2008, [retrieved Jul. 16, 2014], retrieved from http://cvpr.yonsei.ac.kr/publication/papers/inco/Visual%20recognition%20of%20aircraft%20marshalling%20signals%20using%20gesture%20phase%20analysis.pdf, 6 pages.

EDEXCEL, "Unit 30," [online], BTEC Level 3 Nationals specification in Aviation Operations, Issue 1, Oct. 2012, Pearson Education Limited,[retrieved Jul. 16, 2014], retrieved from http://www.edexcel.com/migrationdocuments/BTEC%20Nationals%20fr, 14 pages.

Expedition Portal, "Work, Winch and Recovery Gloves | Expedition Portal," [online] Mar. 8, 2013, http://www.expeditionportal.com/expedition-gear/clothing/1990-work-winch-and-recovery-gloves.html, [retrieved Jul. 16, 2014], retrieved from http://www.expeditionportal.com/expedition-gear/clothing/1990-work-winch-and-recovery-gloves.html, 21 pages.

fuelequip,com, "Fuel handling gloves | Fuel handling clothing | Fuel handling safety gear," [- http://www.fuelequip.com/Quality%20Control-PDF/Nitrile%20Disposable%20Gloves/11149GLOVES.pdf, , [retrieved Jul. 16, 2014], retrieved from http://www.fuelequip.com/Fuel%20handling%20gloves_clothing_safety%20gear.html, 2 pages.

Glow Gear—"Glow Gear—Reflective Trim and Garments," [online], http://www.glowgear.co.za/products/garments, 2014, [retrieved Jul. 16, 2014], retrieved from http://www.glowgear.co.za/products/garments/, 15pages.

KAIA Afganistan International Airport, Aircraft Marshaller,: [online] p://acaa.gov.af/Content/files/KAIA%20Marshaller%20Guide(1).pdf, Mar. 17, 2010, [retrieved Jul. 16, 2014], retrieved from tp://acaa.gov.af/Content/files/KAIA%20Marshaller%20Guide(1).pdf, 90 pages.

Sky Geek, "Supplying the Skies," [online], 2014, http://www.skygeek.com/marshalling-baton.html[retrieved Jul. 16, 2014], retrieved from http://www.skygeek.com/marshalling-baton.html, 2 pages.

TECH/OPS, "Marshalling Gloves/Wands/Paddles—Tech Ops Forum | Airliners.net" [online], http://www., Jul. 5, 2008, [retrieved Jul. 16, 2014], retrieved from http://www.airliners.net/aviation-forums/tech_ops/read.main/232220/, 9 pages.

airliners.net, "Tips on Working the Ramp," [online], http://www.airliners.net/aviation-forums/general_aviation/read.main/2420949/, Nov. 5, 2005, [retrieved Jul. 16, 2014], http://www.airliners.net/aviation-forums/general_aviation/read.main/2420949/, , 6 pages.

* cited by examiner

WEARABLE DEVICES WITH INTEGRATED LIGHT SOURCES

CROSS-REFERENCE TO RELATED APPLICATIONS

This application claims priority to U.S. Provisional Application Ser. No. 61/845,530, entitled "GLOVE WITH INTEGRATED LIGHT SOURCE" and filed on Jul. 12, 2013, the entire contents of which are hereby incorporated by reference.

TECHNICAL FIELD

The present disclosure relates generally to an apparatus for signaling and/or directing vehicles, and/or equipment operators, such as a wearable device that may illuminate and be used for signaling and/or directing.

BACKGROUND

Instruments that have been used for aircraft marshaling include devices that are held by the person doing the marshaling. For example, such devices have included round sticks painted with high visibility paint and a flashlight wand that includes a flashlight with a translucent lens cover extending, at least partially, over the light source for the flashlight. Such devices have been used to communicate commands to drivers and/or pilots through a standardized set of hand and arm signals that are performed while holding the devices.

SUMMARY

This document generally describes wearable devices with integrated light sources that are positioned at particular locations and/or in particular arrangements along the wearable devices so as to provide one or more visual effects, such as when users wear and move the wearable devices. For example, such wearable devices can include gloves with light sources that are positioned along the medial and/or lateral sides of the gloves such that, when the light sources are turned on, the gloves can illuminate and/or highlight the relative positioning and movement of the user's hands, such as when a user is performing air marshalling signals.

In one or more implementations, an apparatus may include a glove article configured to be worn on a human hand, and a first light source situated at least partially on an outside blade of the glove. The apparatus can include a second light source situated on a blade of the glove formed from an edge of the index finger to the joint of the thumb and a third light source located on a palm surface of the glove.

In another implementation, a signaling apparatus includes a glove that is configured to be worn on a hand of a user; a first light source that extends along and is affixed to at least a portion of a lateral side of the glove, the lateral side of the glove corresponding to a lateral side of the user's hand that includes, at least, the user's fifth digit, fifth metacarpal, and ulna bone; and a second light source that extends along and is affixed to at least a portion of a medial side of the glove, the medial side of the glove corresponding to a medial side of the user's hand that includes, at least, the user's radial bone and one or more of: (i) the user's first metacarpal and first digit, and (ii) the user's second metacarpal and second digit.

The signaling apparatus can optionally include one or more of the following features. The first light source can include a first plurality of light emitting diodes (LEDs) and the second light source includes a second plurality of LEDs. The first plurality of LEDs can be arranged in series along the lateral side of the glove and the second plurality of LEDs are arranged in series along the medial side of the glove. The second light source can extend along portions of the medial side of the glove that correspond to, at least, the user's first metacarpal and first digit. The second light source can further extend along portions of the medial side of the glove that correspond to, at least, the user's second metacarpal and second digit. The second light source can extend along portions of the medial side of the glove that correspond to, at least, the user's second metacarpal and second digit.

The signaling apparatus can further include a power source that is affixed to the glove and that is electrically coupled, either directly or indirectly, to the first light source and the second light source. The first light source and the second light source can emit infrared light. The signaling apparatus can further include one or more first portions of reflective material that are affixed to the glove at one or more first locations that are substantially adjacent to the first light source; and one or more second portions of reflective material that are affixed to the glove at one or more second locations that are substantially adjacent to the second light source. The signaling apparatus can further include a user interface that is affixed to the glove and that is configured (i) to receive user input to control operation of the first light source and the second light source and (ii) to provide output identifying a mode of operation for signaling apparatus. The user interface includes one or more of: a display, a touchscreen, buttons, a speaker, a motion sensor, a microphone, and a haptic device. The signaling apparatus can be configured to operate in a dynamic visual effect mode of operation in which the first light source and the second light source are activated in particular ways so as to provide one or more particular visual effect in response to detected gestures; the signaling apparatus can further include one or more motion sensors; a gesture detection unit that is configured to detect gestures that are performed by the user wearing the glove based on movements that are detected by the one or more motion sensors; and a processor that is configured to activate the first light source and the second light source in the particular ways based on the gestures that are identified by the gesture detection unit. The signaling apparatus can be configured to operate in an information reporting mode of operation in which the signaling apparatus transmits information identifying signals that are being performed by a user wearing the glove to a remote computing or communication device; and the signaling apparatus can further include one or more motion sensors; a gesture detection unit that is configured to detect gestures that are performed by the user wearing the glove based on movements that are detected by the one or more motion sensors; and a wireless transceiver that is configured to wirelessly transmit to the remote computing or communication device information identifying signals that are being performed by a user wearing the glove based on the gestures that are detected by the gesture detection unit.

The signaling apparatus can further include another glove that is configured to be worn on the user's other hand; a third light source that extends along and is affixed to at least a portion of a lateral side of the other glove, the lateral side of the other glove corresponding to a lateral side of the user's other hand that includes, at least, the user's fifth digit, fifth metacarpal, and ulna bone on the other hand; and a fourth light source that extends along and is affixed to at least a portion of a medial side of the other glove, the medial side of the other glove corresponding to a medial side of the user's other hand that includes, at least, the user's radial bone on the other hand and one or more of: (i) the user's first metacarpal and first digit on the other hand, and (ii) the user's second metacarpal and second digit on the other hand.

The glove can be constructed from one or more of the materials selected from the group consisting of: leather, polyester, neoprene, nitrile, PVC, cotton, polymer-coated cloth, KEVLAR, and NOMEX.

In another implementation, an apparatus for conveying signals includes a wearable device that is configured to be worn on at least a portion of a user's arm or hand; a first light source that extends along and is affixed to at least a portion of a lateral side of the wearable device; and a second light source that extends along and is affixed to at least a portion of a medial side of the wearable device.

The apparatus can optionally include one or more of the following features. The wearable device can be a glove. The wearable device can be a sleeve. The first light source can extend beyond a distal end of the sleeve and terminates at a first loop that is configured to attach to, at least, a fifth digit on the user's hand, and the second light source can extend beyond the distal end of the sleeve and terminates at a second loop that is configured to attach to, at least, a first digit of the user's hand. The lateral side of the wearable device can correspond to a lateral side of the user's arm or hand, and the medial side of the wearable device corresponds to a medial side of the user's arm or hand.

The details of one or more implementations are depicted in the associated drawings and the description thereof below. Certain implementations may provide one or more advantages. For example, such wearable devices can allow for a user to more readily alternate between performing signaling tasks, such as air marshalling, and other tasks (e.g., fueling, baggage handling, placing airplane wheel chocks) that may rely upon the user to grasp or hold objects, such as fuel lines, wheel chocks, and/or baggage. For instance, using such wearable devices that include properly positioned light sources can allow users to not hold anything in their hands to perform signaling tasks. By not having to hold batons, sticks, or other such handheld signaling devices, users are free to simply transition between signaling tasks and other tasks without having to holster, place, or locate such handheld devices. Such features can provide users with greater convenience and efficiency when performing their duties.

In another example, such wearable devices that include light sources can additionally enhance the safety of users wearing the devices and other users located around them. For instance, while performing tasks that may not rely upon illumination, such as signaling, the light sources of such a wearable device may be activated so as to more clearly indicate the location and positioning of the user wearing the wearable device. Such illumination can help avoid collisions between users and others. Furthermore, such light sources may additionally help illuminate work spaces for users wearing the wearable devices, which can help improve the safety and productivity for such users.

In a further example, such wearable devices including light sources can allow for users to expand upon the tasks that may be performed with extremity-based illuminating devices. For instance, users holding handheld devices to perform signaling tasks previously were limited to holding such devices and were unable to hold other objects in their hands. Using wearable devices that include light sources can allow for a user to further hold objects in addition to perform signaling tasks, or other tasks that may rely upon illumination. For instance, a user could perform signaling tasks for a vehicle (e.g., plane, boat, car, truck) while at the same time holding a video camera that could broadcast a live video stream of the vehicle from the perspective of the user to the driver/captain of the vehicle (e.g., allow the driver/captain to obtain a third-party perspective of the vehicle as it moves).

Additionally, the disclosed wearable devices can adapted for use in a variety of different contexts and can further assist and improve the performance of users in such contexts. For example, wearable devices with light sources can adapted for use by members of the military, such as through the use of light sources emitting infrared (IR) light. In another example, wearable devices with light sources can be adapted to be worn by users signaling and/or controlling traffic (e.g., police/traffic control officers), such as through use of particularly colored light sources. In a further example, wearable devices with light sources can adapted for use by bicyclists, such as making the wearable devices using lightweight and compact materials. In another example, users of personal vehicles, such as motorcyclists, snowmobilers, and/or users of personal watercrafts (e.g., jetskis, sailboats, kayaks, canoes), can use such wearable devices with light sources to make themselves more visible to others, such drivers of larger vehicles like cars, trucks, and motor boats.

In another example, wearable devices with light sources can help users better perform hand-based tasks that would otherwise require the user to hold a light source while performing the task, such as refueling an airplane under poor lighting conditions (e.g., night time, user's body (or other object) casting a shadow on an area where the task is being performed). Wearable devices with light sources can, in general, provide task lighting to users that can be helpful in illuminating objects near or around the user's body, which can help users wearing such wearable devices better operate.

Other features, objects, and advantages of the technology described in this document will be apparent from the description and the drawings, and from the claims.

DETAILED DESCRIPTION

Figure 1:
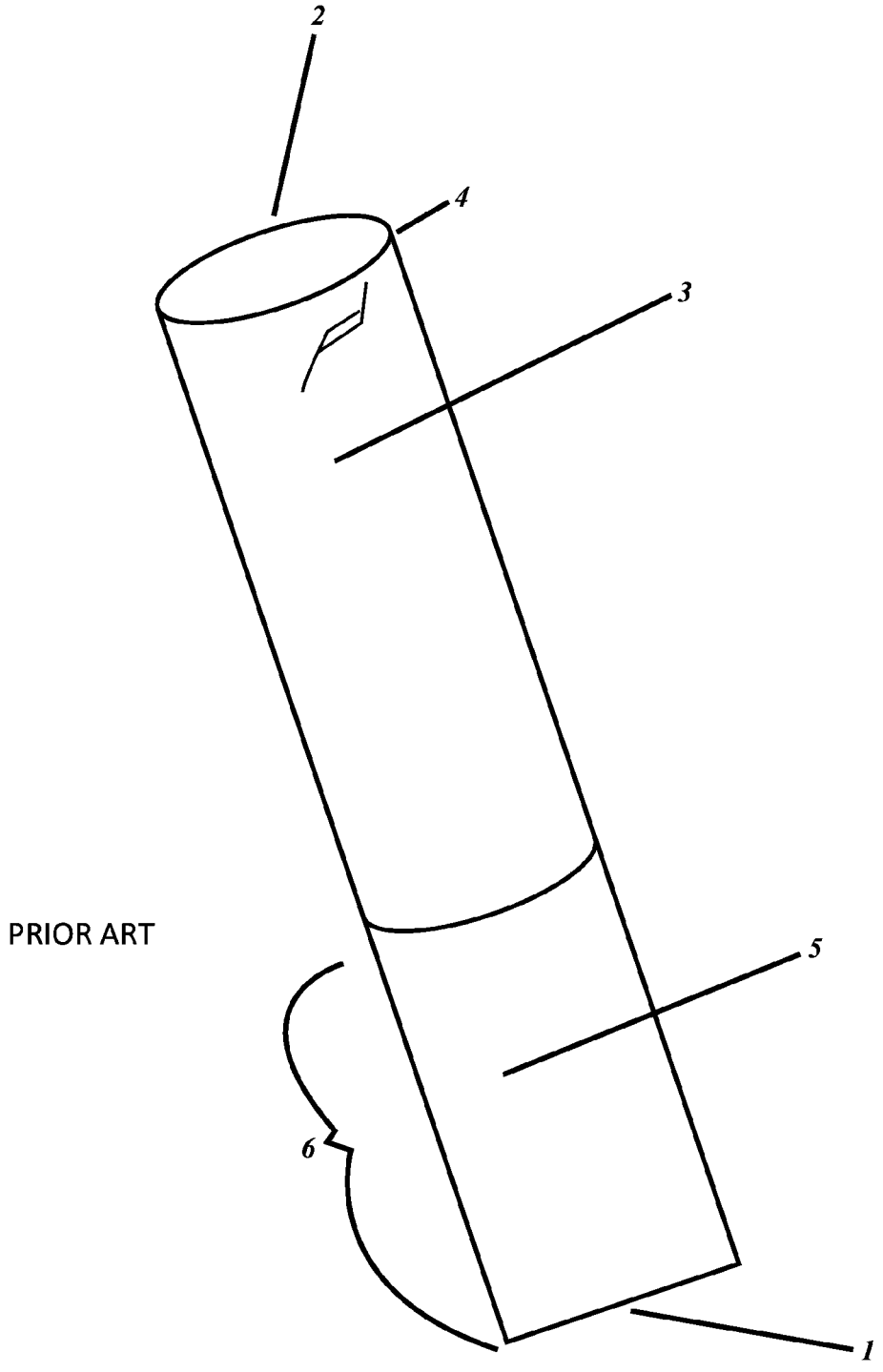
FIG. 1 is an example of a commercially available marshalling stick with a reflective portion and a non-reflective portion for grasping.

The present disclosure describes wearable devices, such as signaling gloves, with integrated light sources that assist users in conveying signals to others through the position and/or movements of the users' bodies, such as providing marshalling signals to operators of vehicles (e.g., aircrafts, boats, trains, trucks) and/or other large machines (e.g., construction equipment, such as cranes and backhoes). Such wearable devices can take any of a variety of forms, such as gloves, sleeves, jackets, shirts, pants, and/or headwear. The light sources can be positioned on such wearable devices at locations that are most visible to others while users are conveying signals using the wearable devices. For example, wearable devices can be gloves that convey hand/arm signals to others, such as air marshalling signals that are conveyed to a pilot of an airplane, and that have light sources positioned on the medial side and lateral sides (or blades) of the gloves (medial side—extending along the ulna bone, the fifth metacarpal, and the fifth digit (pinky finger); lateral side—extending along the radial bone and one or more of: (i) the first metacarpal and first digit (thumb), and (ii) the second metacarpal and second digit (index finger)).

Such wearable devices can allow users to perform signaling tasks without having hold or grasp other devices, such as marshalling aids like sticks and flashlight wands. The use of marshaling aids held in a user's hands may interfere with a variety of other tasks that users may perform before, during, or after signaling, such as performing tasks that rely on the use of one or more free hands (e.g., fueling a plane, placing wheel chocks, loading/unloading cargo, securing tie-down lines, operating another vehicle, communicating using handheld devices (e.g., walkie talkies, phones, cameras)).

Wearable device with light sources can be constructed out of durable materials and in a manner that will protect users' hands in any of a variety of harsh conditions, such as extreme temperatures (e.g., extreme cold, extreme heat), moisture (e.g., rain, snow, sleet), wind, radiation (e.g., UV radiation), and/or chemicals (e.g., fuel). Such durable materials can protect the hands (or other body parts) of the person using the wearable devices and providing the signals, such as marshalling signals. Wearable devices, such as gloves, may additionally be insulated for use in hot and/or cold climates, which may reduce the dexterity of the user and make using handheld signaling devices, such as marshaling aids, difficult for a user to manipulate. By using wearable devices with light sources, as described in this document, users can continue to effectively provide signals even though the wearable device may include insulation.

Materials that can be used for such wearable devise include any of a variety of appropriate materials, such as leather, polyester, neoprene, nitrile, nitrile-coated cloth, PVC, PVC-coated cloth, KEVLAR, and/or fire-resistant materials such as NOMEX. The materials can additionally be manufactured to have one or more colors that, in addition to the light sources, are eye-catching to others, such as yellow, orange, white, green, blue, and/or red. The materials may also include one or more reflective portions or fibers that reflect at least some light when light is cast upon them.

Light sources that may be used as part of the wearable devices can include one or more of a variety of appropriate light sources, such as incandescent light sources (e.g., incandescent light bulbs, halogen lamps), electroluminescent (EL) light sources (e.g., light-emitting diodes (LEDs), light-emitting electrochemical cells (LEECs), electroluminescent sheets and/or wires (EL sheets and/or wires), field-induced polymer electroluminescent sources (FIPEL)), lasers, fiber optics, gas discharge light sources (e.g., fluorescent lamps, induction light sources), and other appropriate light sources. Additionally, the light sources can emit light along one or more appropriate portions of the electromagnetic spectrum, such as visible light and/or infrared light.

FIG. 1 depicts a prior art marshaling wand 1 without a light source. The wand 1 is cylindrical 2 in shape, has a reflective portion 3 at one end 4 and a non-reflective portion 5 at an opposite end 6 for a user to grasp. The wand 1 is configured for a user to grasp the non-reflective portion 5 and aim the reflective portion 3 in a direction visible to a second person receiving the signals.

Figure 2:
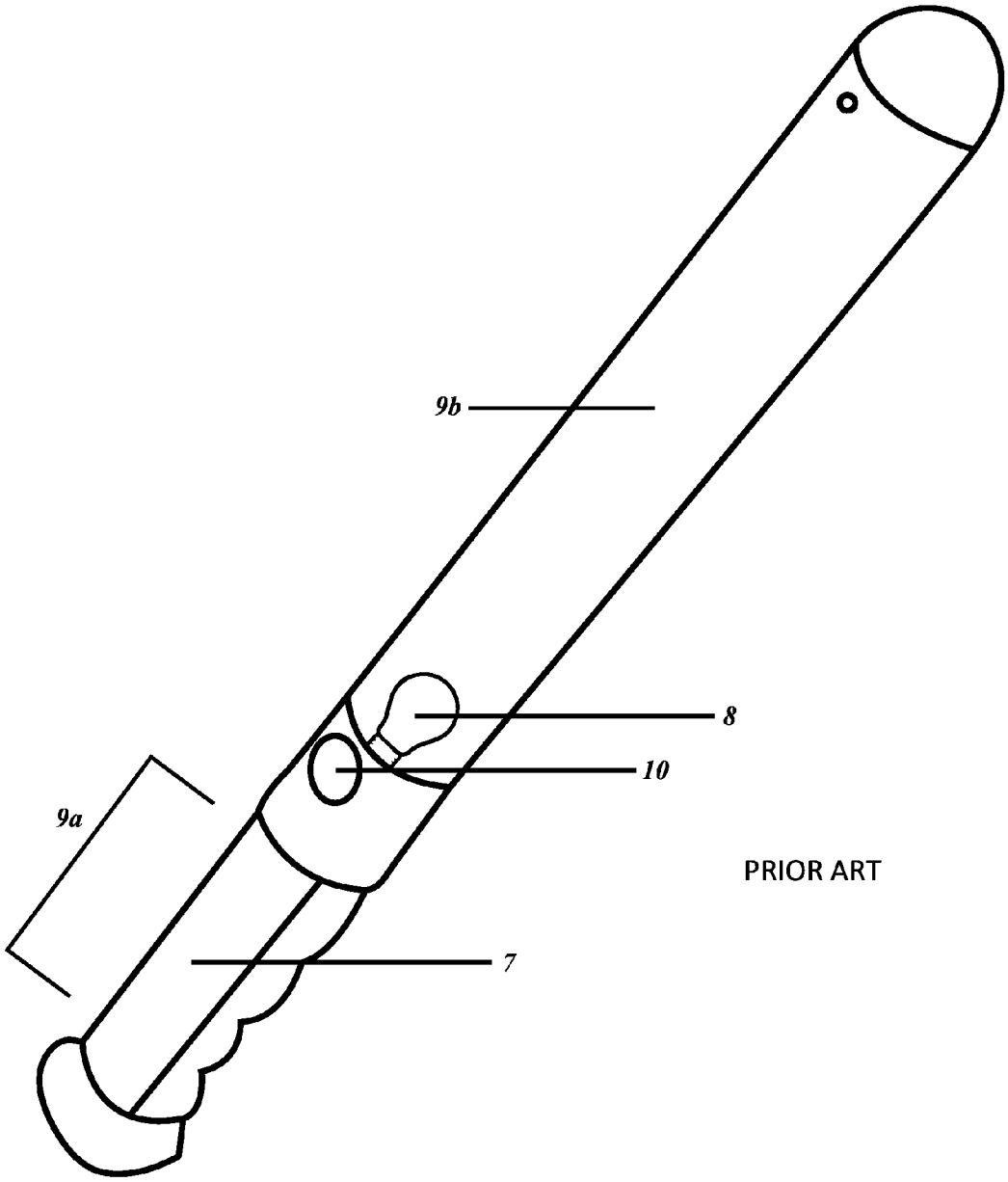
PRIOR ART FIG. 2
FIG. 2 is an example of a commercially available flashlight-style marshalling wand with a flashlight element to serve as the light source and a colored, cone-shaped lens to enhance the visibility of the wand.

FIG. 2 depicts another prior art marshaling wand 7 with a light source. The wand 7 includes a body portion 9*a* with a light source 8 and a lens cover portion 9*b* that is a colored, cone-shaped lens cover. A user can grasp the body 9*a* of the wand 7, activate the power to the light source 8 with a switch 10, and the light source 8 can illuminate the colored lens cover 9*b*. A user can use the wand 7 to convey marshaling signals to others by aiming the illuminated lens cover 9*b* in a direction visible to a person receiving the signals. A user may also execute the marshaling signals using the wand 7 without activating the light source 8.

Figure 3:
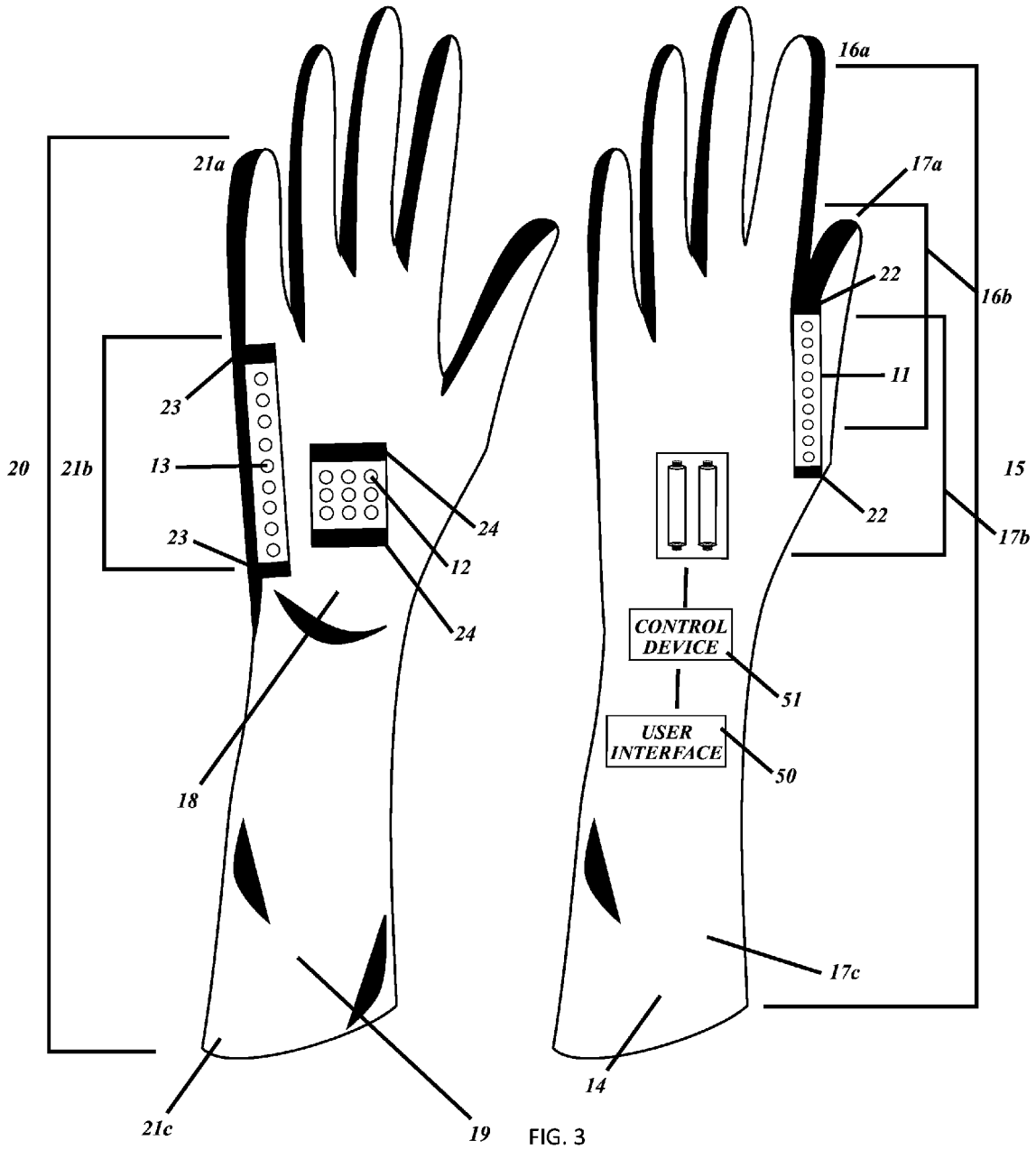
FIG. 3 is a perspective view of an example wearable device with light sources.

FIG. 3 depicts an example wearable device 14, 19 with light sources 11-13. In this example, the wearable device 14, 19 is a pair of gloves that includes light sources 11, 12, and 13. The wearable device 14, 19 includes a left-hand glove 14 and a right-hand glove 19, which are mirror-images of each other. In the example depicted in FIG. 3, a palm 18 of the left-hand glove 14 is visible and a back 26 of the right-hand glove 19 is visible. The features that are depicted and described as being included in the right-hand glove 19, but which are not explicitly depicted for the left-hand glove 14, may also be included as part of the left-hand glove 14, and vice versa for featured depicted for the left-hand glove 14 but not for the right-hand glove 19.

A medial side 20 of the right-hand glove 19 is depicted and extends along a portion of the glove 19 that correspond to a user's fifth digit 21*a* (pinky finger), fifth metacarpal 21*b*, and ulna bone 21*c* (medial side of the wrist). The medial side 20 of the right-hand glove 19 may also be referred to as an outside blade of the glove 19. The glove 19 can include first light source 13 that is affixed to (e.g., permanently/semi-permanently affixed (e.g., sewn, embedded within), temporarily affixed (e.g., VELCRO, magnetic connection)) and extends along, at least, a portion of the medial side 20 of the glove 19. In the depicted example, the first light source 13 extends along a portion of the medial side 20 that corresponds to the fifth metacarpal 21*b*. Other arrangements are also possible. For example, the first light source 13 can extend along the entire length of the medial side 20 of the glove 19 (e.g., from the end of the fifth digit 21*a* to the ulna bone 21*c*). In another example, the first light source 13 can extend along portions of the medial side 20 of the glove 19 corresponding to one or more of: the fifth digit 21*a*, the fifth metacarpal 21*b*, and the ulna bone 21*c*.

Although the medial side of the left-hand glove 14 is not visible in FIG. 3, the left-hand glove 14 can have a medial side similar to the medial side 20 of the right-hand glove 19. The medial side of the left-hand glove 14 can include a light source that is similar to the first light source 13. The light source on the medial side of the left-hand glove 14 can be positioned at one or more locations on the medial side of the left-hand glove 14 that correspond to or are different from the location of the first light source 13 on the medial side 20 of the right-hand glove 19.

A lateral side 15 of the left-hand glove 14 is depicted and extends along a portion of the glove 14 that correspond to a user's second digit 16*a* (index finger), second metacarpal 16*b*, first digit 17*a* (thumb), first metacarpal 17*b*, and radius bone 17*c*. The lateral side 15 of the left-hand glove may also be referred to as an inside blade of the glove 14. The glove 14 can include a second light source 11 that is affixed to and extends along, at least, a portion of the lateral side 15 of the glove 14. In the depicted example, the second light source 11 extends along a portion of the lateral side 15 that corresponds to the second metacarpal 16*b* and the first metacarpal 17*b*. Other arrangements are also possible. For example, the second light source 11 can extend along the entire length of the lateral side 15 of the glove 14 (e.g., from the end of the second digit 16*a* to the radius bone 17*c*, from the end of the first digit 17*a* to the radius bone 17*c*, or any combination thereof). In another example, the second light source 11 can extend along portions of the lateral side 15 of the glove 14 corresponding to one or more of: the second digit 16*a*, the second metacarpal 16*b*, the first digit 17*a*, the first metacarpal 17*b*, and the radius bone 17*c*.

Although the lateral side of the right-hand glove 19 is not visible in FIG. 3, the right-hand glove 19 can have a lateral side similar to the lateral side 15 of the left-hand glove 14. The lateral side of the right-hand glove 19 can include a light source that is similar to the second light source 11. The light source on the lateral side of the right-hand glove 19 can be positioned at one or more locations on the lateral side of the right-hand glove 19 that correspond to or are different from the location of the second light source 11 on the lateral side 15 of the left-hand glove 14.

Also depicted in on the right-hand glove 19 is a palm-side light source 12 that is located on a palm portion 18 of the glove 19 that corresponds to a user's palm. Although a palms portion of the left-hand glove 14 is not visible, the left-hand glove 14 can include a palm-side light source that is location on a palm portion of the glove 14, similar to the palm-side light source 12.

Reflective material (e.g., reflectors, reflective fabric, 3M's SCOTCHLITE) can be positioned at various locations on the gloves 14 and 19 nearby the light sources 11-13. For example, reflective material 22-24 can be located adjacent to each of the light sources 11-13. Other configurations are also possible, such as locating reflective material along the length of the light sources 11-13 in addition, or alternatively, to the reflective materials 22-24 located at the ends of the light sources 11-13. Such reflective material can provide increased visibility for a wearer of the gloves 14 and 19, such as if one or more of the light sources 11-13 are illuminated from a light source emanating from a recipient of a signal, or from another source indirectly.

The gloves 14 and 19 can additionally include one or more appropriate power sources to power the light sources 11-13. Each of the gloves 14 and 19 may include one or more power sources, or they may share a power source through the use of a connection, such as a cable or wire. The power source(s) may be placed at one or more appropriate locations on the gloves 14 and 19, such as locations where they are likely to have the least impact on performance of tasks while using the gloves 14 and 19. For example, an example power source 25 is located on a back portion 26 of the glove 14 that corresponds to the back of the hand. The glove 19 can also have a power source located on a back portion of the glove 19, which is not depicted in FIG. 3. Power sources can additionally or alternatively be placed at a variety of other locations on the gloves 14 and 19. Power sources can include any of a variety of appropriate mechanisms to power the light sources 11-13, such as batteries, wearable photovoltaics (e.g., wearable solar cells, organic photovoltaics, embedded photovoltaics), motion-based power generators (e.g., magnetic power generators), or any appropriate combination thereof. The left hand 14 and right hand 19 of the pair of gloves can have identical configurations of light sources 11, 12, and 13, power sources 25, and reflectors 22, 23, and 24.

The example light sources 11-13 are depicted as including a plurality of individual light sources (e.g., LEDs), as denoted by the circles depicted within the light sources 11-13, that are enclosed within a contiguous housing. Such a housing can include one or more materials that allow light from the light sources to pass through the housing, such as materials that are translucent (e.g., light diffusing material) and/or transparent (e.g., clear material). The light sources 11-13 can include one or more individual light sources within such a housing which may extend along portions of the gloves 14 and 19. The light sources 11-13 may alternatively be composed of divided portions that are separate from each other along the lengths of the lateral and medial sides of the gloves 14 and 19. For example, the individual light sources (circles) that are depicted as being part of the light sources 11 and 13 may be individually located along the sides of the gloves 14 and 19 without being contained within a common housing (e.g., each of the individual light sources is affixed to the gloves 14 and 19 outside of a housing). In another example, portions of the individual light sources that are part of the light sources 11 and 13 can be contained within separate housings, such as a first housing that may extend along digit portions of the gloves 14 and 19 (e.g., portions 21*a*, 16*a*, and 17*a*), a second housing that may extend along metacarpal portions of the gloves 14 and 19 (e.g., portions 21*b*, 16*b*, and 17*b*), and/or a third housing that may extend along a wrist portion of the gloves 14 and 19 (e.g., portions 21*c* and 17*c*).

The light sources 11-13 can be provided with any of a variety of appropriate patterns on the gloves 14 and 19. For example, the light sources 11 and 13 are depicted as being arranged in a linear pattern. In another example, the light source 12 is arranged in a rectangular pattern. Other patterns are also possible, such as asymmetric patterns (e.g., patterns in which the light source is wider on one end than another), curvilinear patterns (e.g., patterns with curved and linear portions), and/or other appropriate patterns.

As described above, the light sources 11-13 can each include one or more of a variety of appropriate light sources, such as incandescent light sources (e.g., incandescent light bulbs, halogen lamps), EL light sources (e.g., LEDs, LEECs, electroluminescent sheets and/or wires (EL sheets and/or wires), FIPEL), fiber optics, lasers, gas discharge light sources (e.g., fluorescent lamps, induction light sources), and/or other appropriate light sources. Additionally, the light sources 11-13 can emit light along one or more appropriate portions of the electromagnetic spectrum, such as visible light and/or infrared light.

The gloves 14 and 19 may additionally include one or more user interfaces, such as a user interface 50 that is depicted on a back surface of the left-hand glove 14. The user interface 50 can include one or more mechanisms through which user input can be received to control operation of the light sources 11-13. Such mechanisms can be any of a variety of appropriate mechanisms, such as mechanical devices (e.g., physical switches, physical buttons), electronic devices (e.g., touchscreens/touchpads, graphical displays), sensors (e.g., motion sensors such as accelerometers and gyroscopes), or any combination thereof. Although not depicted, the glove 19 may also include a user interface similar to the user interface 50. Additionally, the user interface 50 may be positioned on the glove 14 (and/or 19)

in any of a variety of appropriate locations where it is convenient for a user to access and use, such as on the back of the glove.

The user interface 50 can be coupled to a control devices 51 that can control operation of the light sources 11-13 on one or both of the gloves 14, 19. The control device 51 can include any of a variety of appropriate devices to control operation of the light sources 11-13, such as switches, microprocessors, wireless transceivers, or any combination thereof. For example, the control device 51 can include a wireless transceiver to transmit instructions for operation of the light sources 11-13 to a corresponding control device with a wireless transceiver that is part of the glove 19. The user interface 50, the control device 51, and the power source 25 may be part of a common device or separate devices.

Figure 4:
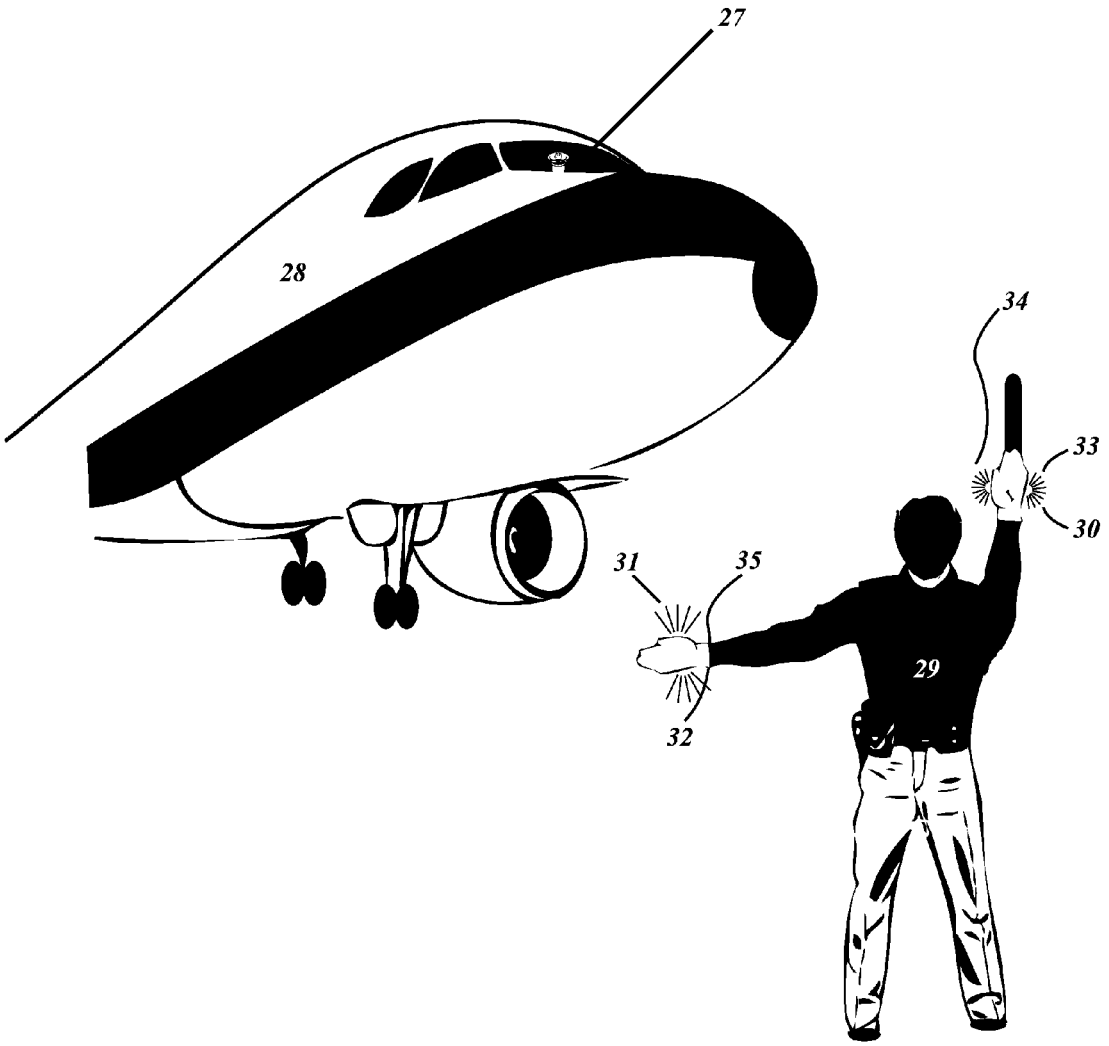
FIG. 4 depicts a user using an example wearable device with light sources to provide marshalling signals to an example vehicle.

FIG. 4 depicts a signaling user 29 using example wearable devices 30, 31 to signal to a viewing user 27 that is operating an example vehicle 28. The example wearable devices 30, 31 can be any of a variety of appropriate wearable devices, such as gloves (e.g., the gloves 14, 19), sleeves, jackets, hats, pants, shoes, shirts, or any combinations thereof. The wearable devices 30, 31 can include example light sources 32-35 that may each, depending on the orientation of the devices 30, 31 relative to the vantage point of the viewing user 27, project light to the viewing user 27. The example vehicle 28 can be any of a variety of appropriate vehicles or machines that may benefit from interaction between an operator (e.g., the viewing user 27) and a signaling user (e.g., the signaling user 29), such as airplanes, boats, trucks, trains, and/or construction equipment/machinery.

As depicted in FIG. 4, the viewing user 27 that is operating the aircraft 28 receives signals from the signaling user 29 wearing the wearable devices 30, 31 (e.g., signaling gloves). The signaling user 29 can provide and the viewing user 27 can receive distinct signals depending on the orientation of the wearable devices 30, 31, as manipulated by the signaling user 29. For example, the signaling user 29 can orient his/her hand wearing device 30 in one direction, and his/her other hand wearing device 31 in another direction to provide a signal to the viewing user 29, for example, based on a combination of the light sources 32-35 that are visible by the viewing user 27. Such signals, based on combinations of light sources 32-35 that are visible by the viewing user 27, may additionally vary depending on the orientation of the signaling user 29 relative to the position of the viewing user 27 and may be specific to the signal being communicated.

Figure 5:
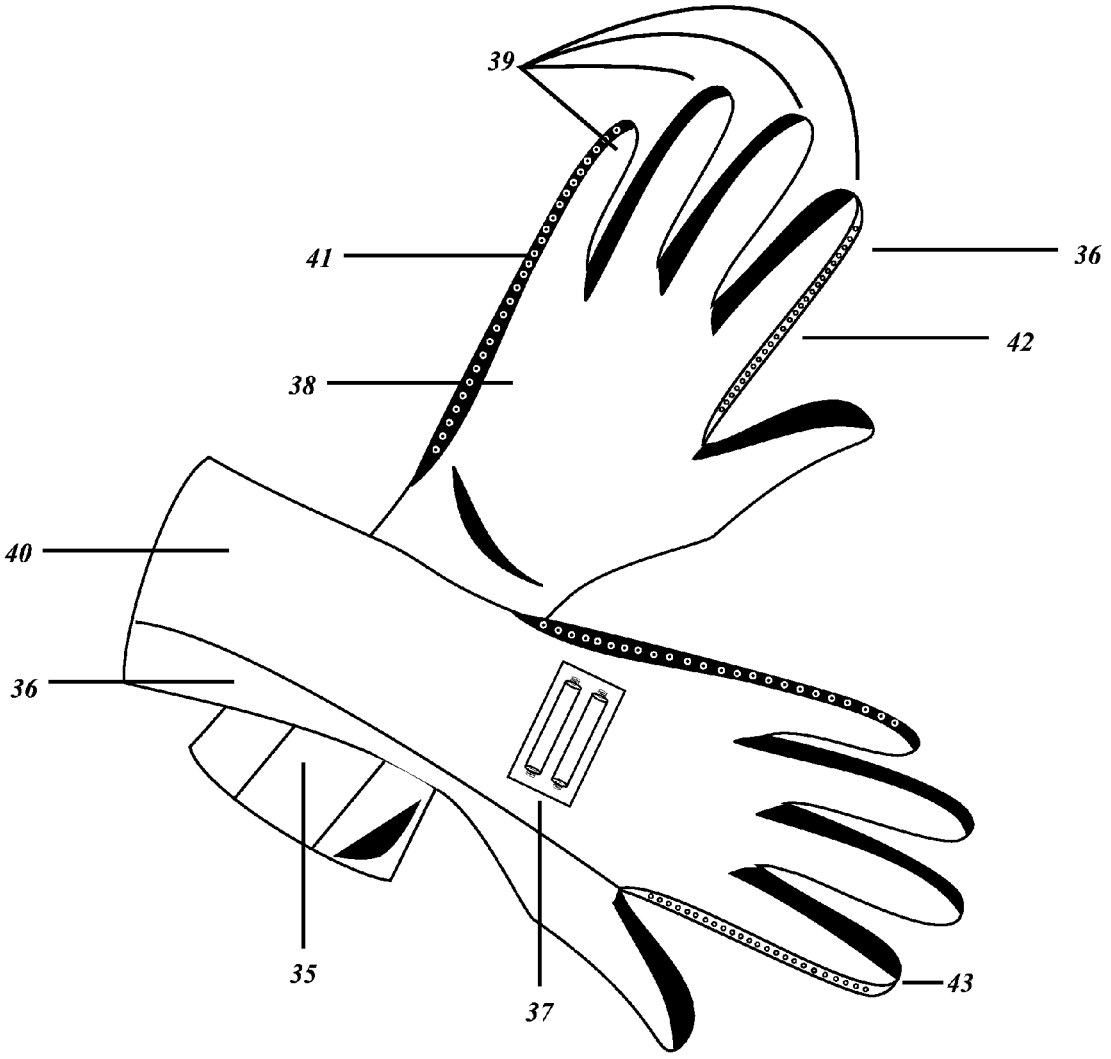
FIG. 5 depicts an example wearable device with light sources.

FIG. 5 depicts an example configuration for a wearable devices 35. The wearable devices 35 in this example are gloves, but may be other suitable types of wearable devices, as discussed above. The wearable devices 35 may be made of any of a variety of appropriate materials, such as a fabrics like leather, NOMEX, KEVLAR, PVC, cotton, wool, and/or other suitable materials depending on the climate and/or use (e.g., commercial, governmental, or military application). Portions of the devices 35 can have reflective surfaces 36 integrated into material, such as along the medial and lateral sides of the gloves. The devices 35 can have light sources 41-43 positioned along and affixed to/embedded within the reflective surfaces 36. The light sources 41-43 can include one or more power supplies 37, such as batteries. The palm portion 38 of the glove may made of a different material from materials used in the finger portions 39 and/or the portions covering the opposite, back side of the hand 40 of the glove, depending on the use of the devices 35 and/or preferences of the users. The materials may be different to improve the grip, visibility, or personalization preferences of the wearer. In other embodiments, the glove may be made from a single material.

FIGS. 6A-F depict various views of wearable devices 60, 62 with light sources 64-70 positioned along the lateral and/or medial sides of the devices 60, 62. The example wearable devices 60, 62 in this example are gloves. However, as discussed above, the wearable devices 60, 62 may be any of a variety of other appropriate wearable devices.

The light sources 64-70 are positioned along the medial and lateral sides of the gloves 60 and 62. For example, the light sources 64*a* and 64*b* are positioned along the lateral sides of gloves 60 and 62, respectively; the light sources 66*a* and 66*b* are positioned along the medial sides of gloves 60 and 62, respectively; the light sources 68*a* and 68*b*, which may be included in some implementations, are positioned along the medial sides of gloves 60 and 62, respectively; and the light sources 70*a* and 70*b* are positioned along the medial sides of gloves 60 and 62, respectively.

Figure 6A:
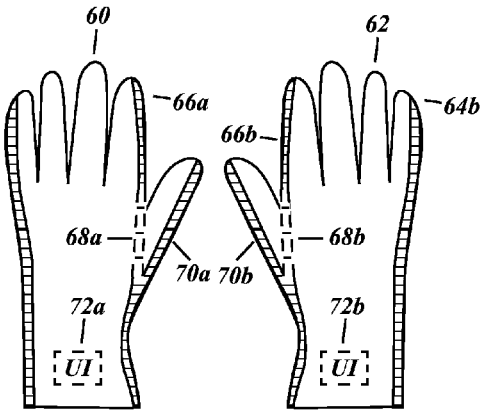
FIGS. 6A-F depict various views of an example wearable device.
Figure 6F:
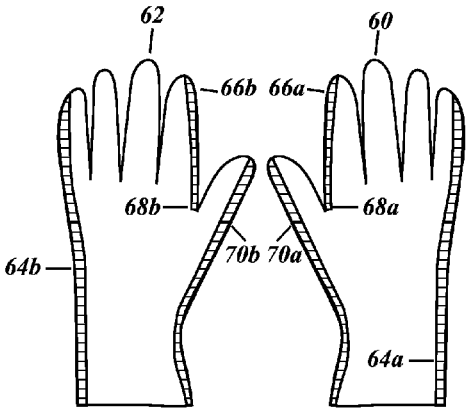
Figure 6B:
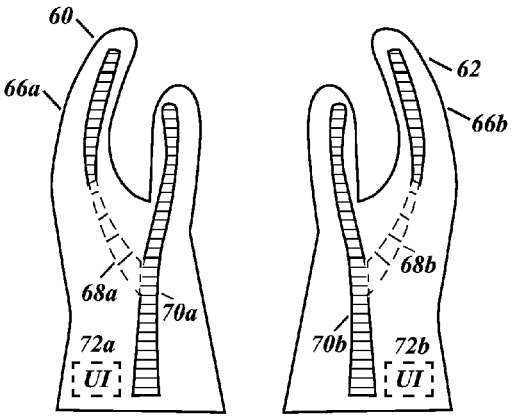
Figure 6C:
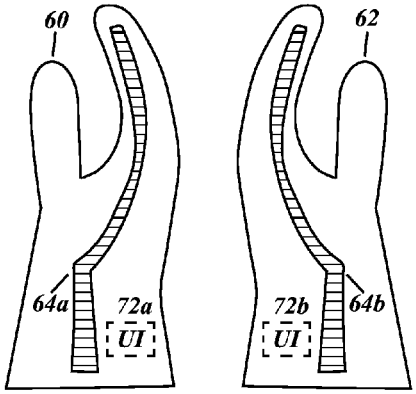
Figure 6D:
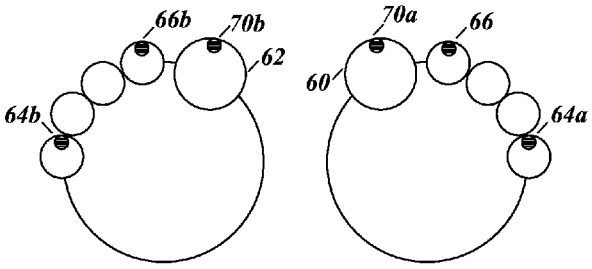
Figure 6E:
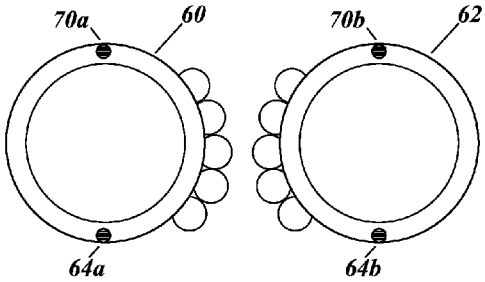

FIG. 6A depicts a top-down view of the backside of gloves 60 and 62 (opposite the palm side). FIG. 6B depicts a side view the medial sides of the gloves 60 and 62. FIG. 6C depicts a side view the lateral sides of the gloves 60 and 62. FIG. 6D depicts a front-end view of the fingers of the gloves 60 and 62. FIG. 6E depicts a back-end view of the openings of the gloves 60 and 62. FIG. 6F depicts a bottom view of the palm side of the gloves 60 and 62.

The light sources 64-70 may extend along all or a portion of each designated region and may be positioned in any of a variety of appropriate patterns, such as being positioned in series, in rows and columns, staggered along different columns, in symmetric arrangements, and/or in asymmetric arrangements. The light sources 64-70 can be any of a variety of appropriate light sources, such as incandescent light sources (e.g., incandescent light bulbs, halogen lamps), EL light sources (e.g., LEDs, LEECs, electroluminescent sheets and/or wires (EL sheets and/or wires), FIPEL), fiber optics, lasers, gas discharge light sources (e.g., fluorescent lamps, induction light sources), and/or other appropriate light sources. Additionally, the light sources 64-70 can emit light along one or more appropriate portions of the electromagnetic spectrum, such as visible light and/or infrared light.

The gloves 60 and 62 may optionally include one or more user interfaces 72*a-b* that are positioned at convenient locations on the gloves 60 and 62 for users. For example, the user interfaces 72*a-b* can be positioned on the back side of the gloves 60 and 62. In some implementations, the gloves 60 and 62 may include a user interface on only one of the gloves, which may transmit, through a wireless or wired connection, instructions received to a controller on the other glove.

Other configurations are also possible. For example, additional light sources may be positioned along the palm of the gloves 60 and 62, along the back of the gloves 60 and 62, or along the fingers of the gloves 60 and 62.

Figure 7:
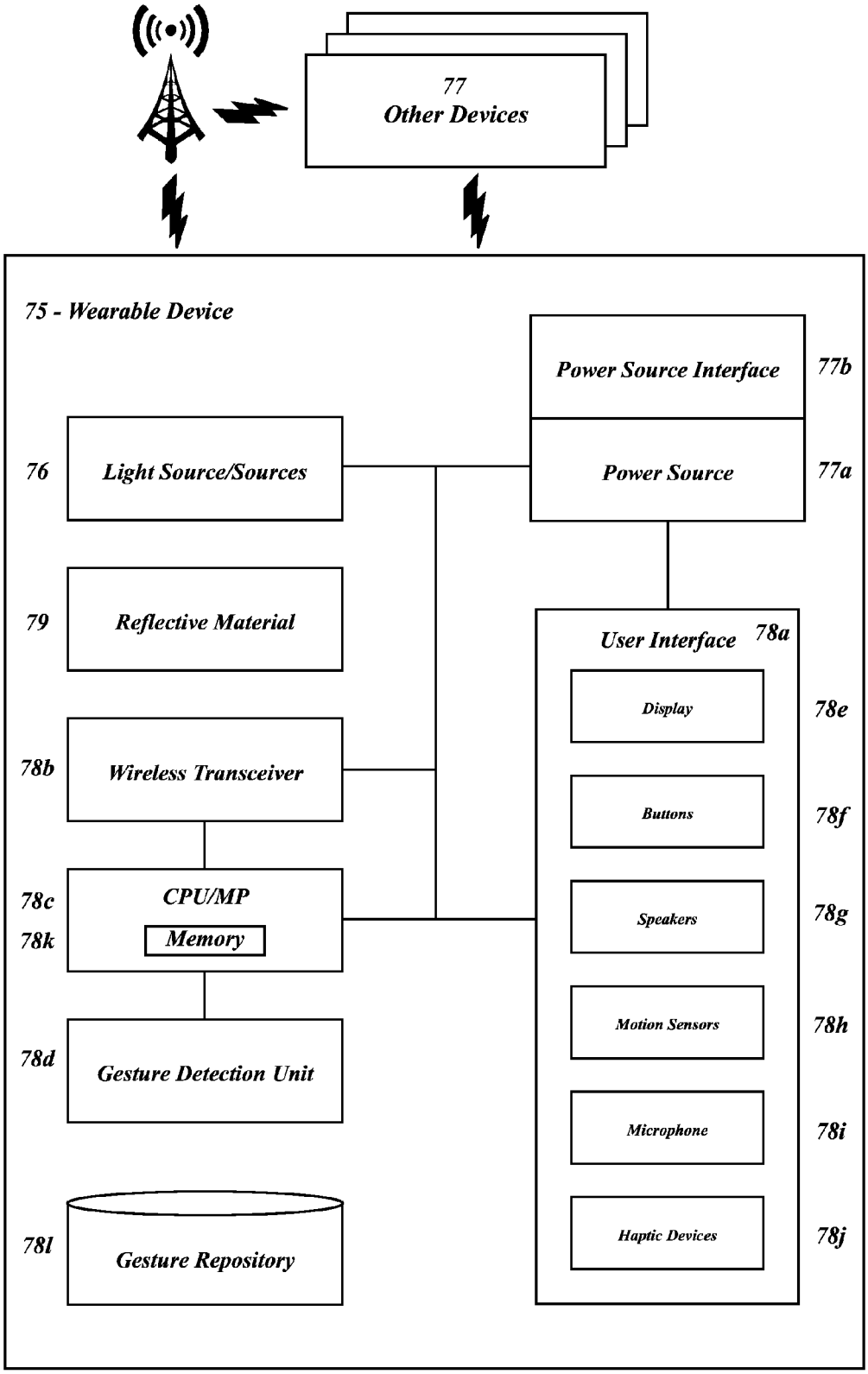
FIG. 7 is a diagram that depicts a system that includes a wearable device with light sources and other devices.

FIG. 7 is a diagram that depicts a system 74 that includes a wearable device 75 with light sources 76 and other devices 77. The wearable device 75 can be any of a variety of appropriate wearable devices, such as gloves, sleeves, jackets, shirts, hats, pants, boots, vests, shorts, jumpsuits, or any combination thereof. The wearable device 75 can be the same as or similar to the wearable devices that are described above, such as wearable devices 14, 19, 30, 31, 35, 60, and 62 that are described above with regard to FIGS. 3-6.

The light sources 76 can be positioned at appropriate locations along the wearable device 75 so as to assist a user in providing signals through movement of the wearable device, such as along the medial and lateral sides of a glove. The light sources can include one or more appropriate types of light sources, such as incandescent light sources (e.g., incandescent light bulbs, halogen lamps), EL light sources (e.g., LEDs, LEECs, electroluminescent sheets and/or wires (EL sheets and/or wires), FIPEL), fiber optics, lasers, gas discharge light sources (e.g., fluorescent lamps, induction light sources), and/or other appropriate light sources. Additionally, the light sources 76 can emit light along one or more appropriate portions of the electromagnetic spectrum, such as visible light and/or infrared light.

The light sources 76 can generate and project light from energy that is supplied by a power source 77*a*. The power source 77*a* can be any of a variety of appropriate power sources, such as batteries, wearable photovaltaics (e.g., wearable solar cells, organic photovaltaics, embedded photovaltaics), motion-based power generators (e.g., magnetic power generators), or any appropriate combination thereof. The power source 77*a* may be connected to one or more power source interfaces 77*b* (e.g., charging port such as a USB port, a DC charging port, an AC charging port) through which the power source 77*a* may be charged by one or more external power sources.

The power source 77*a* can additionally provide power to one or more other components of the wearable device 75, such as a user interface 78*a*, a wireless transceiver 78*b*, a central processing unit (CPU)/microprocessor 78*c*, and/or a gesture detection unit 78*d*. The user interface 78*a* can be similar to the user interfaces described above with regard to FIGS. 3-6, and can include any of a variety of appropriate input/output mechanisms, such as a display 78*e* (e.g., LCD display, LED display, touchscreen), buttons 78*f* (e.g., physical buttons, virtual buttons, physical switches, electro-mechanical devices that can be toggled between different modes of operation), speakers 78*g* (e.g., audio speakers), motion sensors 78*h* (e.g., accelerometers, gyroscopes), microphones 78*i*, and/or haptic devices 78*j* (e.g., devices providing haptic output). For example, the user interface 78*a* can include components to provide a visual interface that allows a user to interact with the device 75 through visual features (e.g., text, icons, lights), a audio interface that allows a user to interact with the device 75 through sound (e.g., speech, audible prompts), a motion-based interface that allows a user to interact with the device 75 through movement of the device 75 (e.g., movement causes the device 75 to automatically turn on, inactivity (no movement above a threshold level) for at least a threshold period of time causes the device 75 to automatically turn off), or any combination thereof.

The CPU/microprocessor 78*c* can control operation of electrical/electro-mechanical components of the wearable device 75, such as the user interface 78*a*, the components 78*e*-78*j* of the user interface 78*a*, the power source 77*a*, the light sources 76, the gesture detection unit 78*d*, and the wireless transceiver 78*b*. The CPU can execute one or more sets of instructions that are stored/loaded into memory 78*k* (e.g., random access memory (RAM)) to determine how each of such components should be controlled at a given point in time based on various inputs and modes of operation for the wearable device 75. For example, when the wearable device 75 is initially powered on, the light sources 76 may be deactivated (turned off) and the user interface 78*a* may provide output (e.g., display message on the display 78*c*, illuminate/highlight particular buttons 78*f*, audibly prompt/instruct the user through the speakers 78*g*, provide particular haptic feedback through the haptic devices 78*j*) that identifies one or more functions that are available to the user from such an initial power-up mode of operation, such as activating (turning on) the light sources 76 and/or activating the gesture detection unit 78*d*.

In another example, the CPU/microprocessor 78*d* can receive gesture identifications from the gesture detection unit 78*d* (e.g., identifications of gestures that have been detected through use of the motion sensors 78*h*) and can use the identifications to cause the wireless transceiver 78*b* transmit information that identifies the gestures to one or more other devices 77, such as computing and/or communication devices that are located with a viewing user (e.g., viewing user 27) who is operating a vehicle/machine to which the signals from the wearable device 75 apply. Such other devices 77 can provide the received information regarding the signals that are being performed using the wearable device 75 to one or more users who are associated with the other devices 77, such as operators of vehicles and machines to which the signals pertain. For example, such another device 77 can convert the information into messages that are audibly output through a speaker or visually output through a display. Additionally, such other devices 77 may be configured with safety mechanisms to provide warnings when operation of an associated vehicle/machine deviates from the signals/instructions that are received from the wearable device 75 (e.g., when a signal to stop is provided by the wearable device 75 and the machine/vehicle associated with the other device 77 does not stop, a warning can be provided to a user and/or an automatic override can cause the vehicle/machine to automatically stop).

In a further example, the CPU/microprocessor 78*c* can control rapid activations and deactivations of portions of the light sources 76 so as to provide one or more visual effects a viewing user (e.g., viewing user 27). For instance, the light sources 76 may be sequentially activated and deactivated so as to provide a landing strip type effect. In another example, the light sources 76 may be activated and deactivated in unison so as to provide a blinking or strobe type effect. In another example, the light sources 76 may be set to one or more particular colors (e.g., red, blue, white, yellow, orange, green). Such visual effects may additionally convey information from a user wearing the wearable device 75 to another user who is viewing the signals.

In another example, the CPU/microprocessor 78*c* can cause the wireless transceiver 78*c* to transmit instructions to one or more the other devices 77. For instance, the other devices may also be wearable devices similar to the wearable device 75. The wearable device 75 can transmit information that identifies a current mode of operation of the wearable device 75 (e.g., light source 76 is activated, visual effect being performed on the light source 76) to such another device, which can be received at a wireless transceiver of the other device and can cause the other device to perform enter the same mode, a similar mode, or a complimentary mode of operation. For example, the wearable device 75 can be one glove and the other device to which the information is transmitted can be another glove. Input received through the user interface 78*a* on one of the gloves can be transmitted to the other glove, which may or may not have a user interface, so that a user can control both gloves through input received at just one of the gloves.

The gesture detection unit 78*d* can be a computational unit that can perform one or more computational tasks based on input received through the motion sensors 78*h* (and/or other sensors or input devices) to identify one or more gestures that are being performed by a user of the wearable device 75. The gesture detection unit 78*d* can use pre-identified gestures stored in a gesture repository 78*l* to identify gestures based on such inputs. For example, the information stored in the gesture detection repository 78*l* can correlate particular motions and orientations of the wearable device 75 with particular gestures, such as marshalling signals. The gesture detection unit 78*d* can be implemented in any of a variety of appropriate ways, such as through instructions (e.g., software) that cause the CPU/microprocessor 78*c* to perform the described operations, through hardware (e.g., application specific integrated circuits (ASICs)), firmware, or any combination thereof.

The wireless transceiver 78*b* include one or more appropriate wireless transceivers, such as wireless radio transceivers like Wi-Fi transceivers, short-range wireless transceivers (e.g., BLUETOOTH transceivers), cellular network transceivers, and/or mobile data network transceivers (e.g., 3G/4G transceivers). The wireless transceiver 78*b* can allow the wearable device 75 to communicate with the other devices 77, which can include other wearable devices, computing/communication devices that are associated with users receiving/viewing signals (e.g., users operating machines/vehicles relying on such signals) from the wearable device 75, and/or other computer systems (e.g., computer systems logging activity of the wearable device 75). The wireless transceiver 78*b* can communicate with the other devices 77 either directly or through one or more intermediate transceivers and/or networks, such as Wi-Fi networks, cellular networks, and/or mobile data networks.

The wearable device 75 can additionally include reflective material 79 that is positioned at appropriate locations along the wearable device 75 to as to augment signals provided using the wearable device 75 and to provide enhanced visibility of the user of the wearable device 75 (e.g., increased visibility).

FIGS. 8A-F depict various views of an example wearable device 80 that includes a sleeve portion 81 with light sources 82*a-c* and 83*a-c*. The wearable device 80 can be similar to the wearable devices described above with regard to FIGS. 3-7 and can include the same or similar features described with regard to those wearable devices.

Figure 8A:
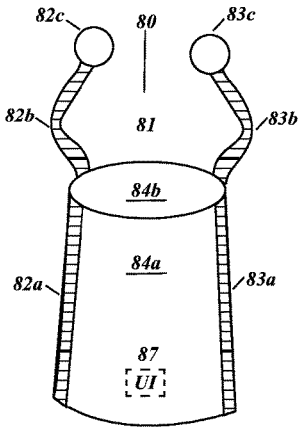
FIGS. 8A-F depict various views of an example wearable device that includes a sleeve portion with light sources.
Figure 8E:
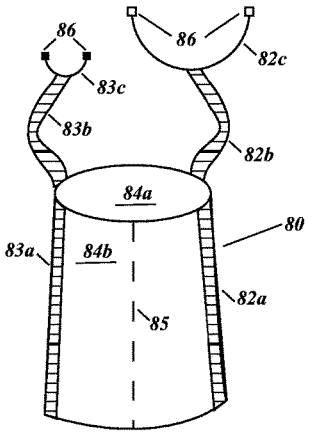
Figure 8B:
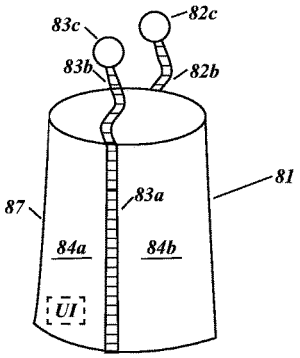
Figure 8C:
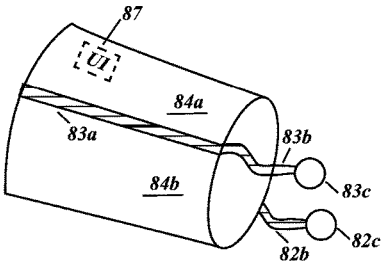
Figure 8D:
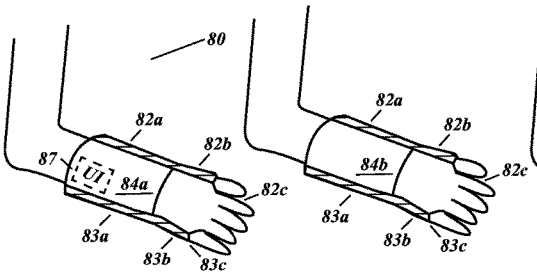
Figure 8F:
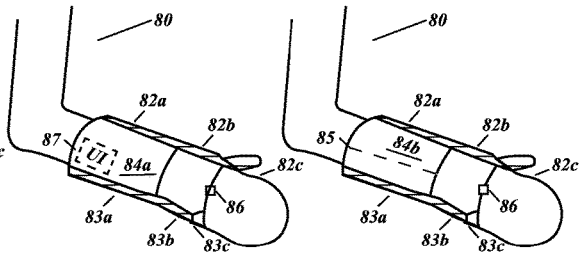

FIG. 8A depicts a top-down view of the wearable device 80. FIG. 8B depicts a side view of a lateral side of the wearable device 80. FIG. 8C depicts a perspective view of the wearable device 80. FIG. 8D depicts the wearable device 80 being worn by a user. FIG. 8E depicts a bottom view of the wearable device 80. FIG. 8F depicts a the wearable device 80 being worn by a user wearing mittens.

The example sleeve-based wearable device 80 that is depicted in FIGS. 8A-F may, in some implementations, be part of a larger garment or wearable item. For example, the wearable device 80 may be part of a jacket and long-sleeve shirt.

The wearable device 80 may, in certain implementations, provide a variety of benefits to a user. For example, the wearable device 80 can permit a user to provide illuminated signals through a wearable device independent of a particular pair of gloves. For instance, the wearable device 80 may be worn without gloves, as depicted in FIG. 8D, or may be worn with gloves/mittens of the user's choosing, as depicted in FIG. 8F. This may allow a user to readily adjust his/her dress to appropriate levels based on the current climate and weather for the user, without being tethered to a pair of gloves that may be too warm in some conditions or not warm enough in other conditions. Furthermore, the lifespan of the wearable device 80 may not be tied to the durability of a particular glove, which may wear out in a shorter timespan than the electronic components of the wearable device 80.

The wearable device 80 includes a first light source 82*a-c* that extends down a medial side of the sleeve 81 and a second light source 83*a-c* that extends down a lateral side of the sleeve 81. The sleeve 81 includes a top portion 84*a* and a bottom portion 84*b*. The light sources 82*a-c* and 83*a-c* each include affixed light source portions 82*a* and 83*a* that are affixed to the sleeve 81, untethered light source portions 82*b* and 83*b* that are not affixed to the sleeve 81 and that extend distally from an end of the sleeve 81, and loops 82*c* and 83*c* that are attached to the other end of the untethered light source portions 82*b* and 83*b* and that loop around one or more digits of a user's hand/glove to anchor the other end of the untethered light source portions 82*b* and 83*b* to a position near the distal end of the user's hands.

The loop 83*c* on the medial side of the wearable device 80 can be sized to fit a user's thumb. The loop 82*c* on the lateral side of the wearable device 80 can be sized to fit one or more of the user's fingers. The loops 82*c* and 83*c* may be adjustable in size and can be open loops with mechanisms 86 (e.g., VELCRO, buttons) to attach the open ends of the loops together.

The sleeve 81 may also include a mechanism 85 (e.g., zipper, VELCRO) for the sleeve to be opened and secured around a user's arm/wrist/hand. The device 80 may also include a user interface 87, which may be located on a top portion 84*a* of the sleeve 81 or in other appropriate locations.

Figure 9:
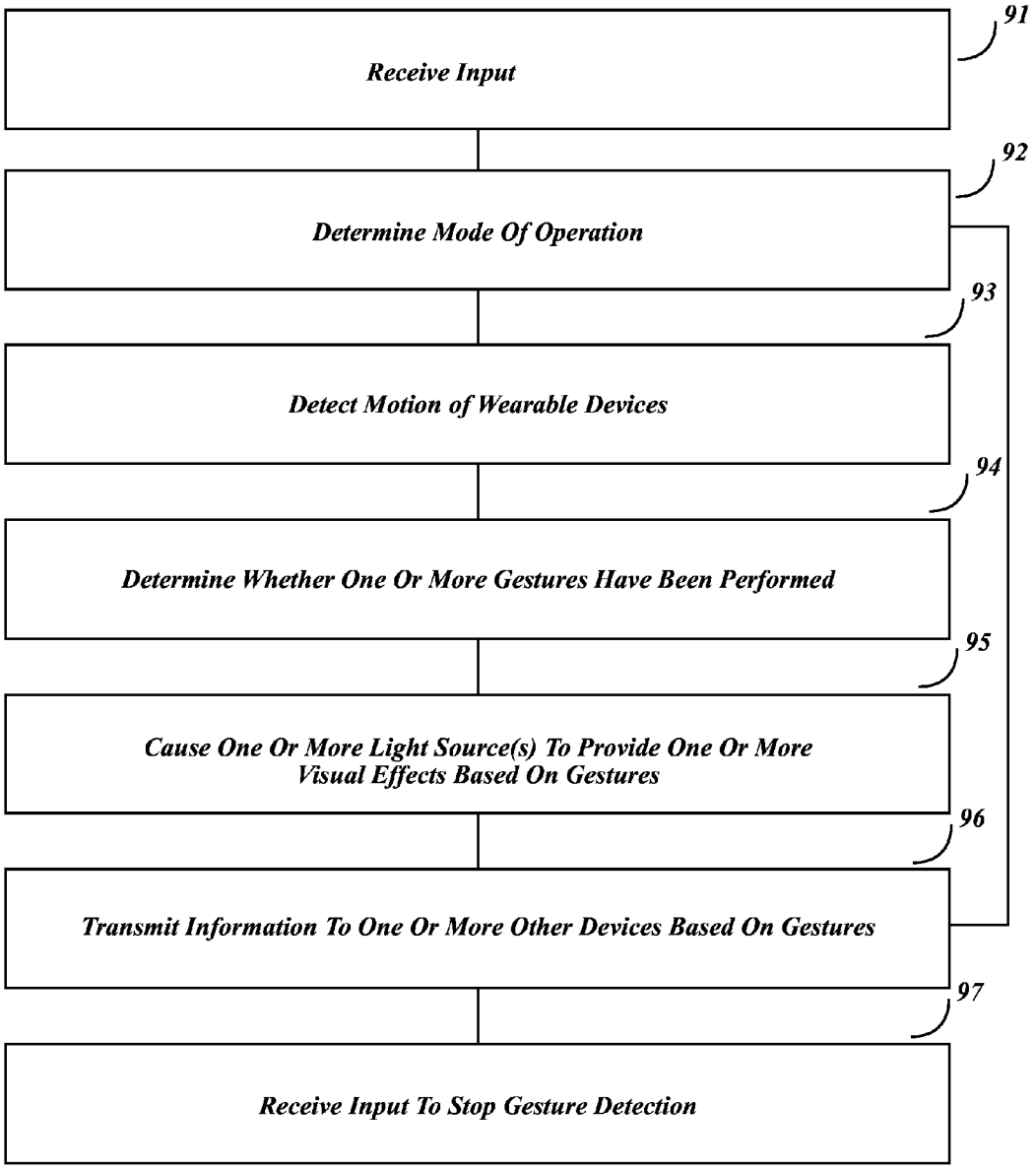
FIG. 9 is a flowchart of an example technique for a wearable device to perform gesture based operations.

FIG. 9 is a flowchart of an example technique 90 for a wearable device to perform gesture based operations. The technique 90 can be performed by any of a variety of appropriate wearable devices, such as the wearable devices 14, 19, 30, 31, 35, 60, 62, 75, and/or 80.

Input is received by a wearable device (91) and, based on the input, a current mode of is determined (92). For example, input can be received through the user interface 78*a* of the wearable device 75 and, based on the input, the wearable device 75 determines what mode of operation is currently desired by a user of the wearable device 75. Modes of operation can vary depending on the type of application for the wearable device. For instance, when used for marshaling airplanes, modes of operation that may be selected may include the light sources 76 being deactivated (turned off), the light sources 76 being activated (turned on), static user-selected visual effects for the light sources 76 (e.g., user selects for the light sources 76 to blink until instructed not to do so), dynamic visual effects of the light sources 76 based on gestures performed using the wearable device 75 (e.g., cause the light sources 76 to perform particular visual effects when particular gestures are detected), reporting of information regarding signals being performed to one or more other devices (e.g., wireless transmission of signal information to the other device(s) 77 based on detected gestures), automatic activation/deactivation based on motion of the wearable device 75 (e.g., automatically turn off the light sources 76 after a threshold period of inactivity, automatically turn on the light sources 76 in response to a threshold level of movement of the wearable device 75), or any combination thereof.

For modes of operation in which motion/gesture detection may be relevant to operation of the wearable device and its light sources, motion of the wearable device can be detected (93). For example, when in a mode of operation such as automatic activation/deactivation based on motion of the wearable device 75, reporting of information regarding signals being performed to one or more other devices, dynamic visual effects of the light sources 76 based on gestures performed using the wearable device 75, or other appropriate modes of operation, the wearable device 75 can use the gesture detection unit 78*d* and the motion sensors 78*h* to detect motion of the wearable device 75. Based on the detected motion, a determination can be made as to whether one or more gestures have been detected (94). For example, the gesture detection unit 78*d* can reference the gestures stored in the gesture repository 78*l* to determine whether movement wearable device 75 sufficiently matches one or more pre-identified gestures, such as signaling gestures.

Based on the detected gestures and the mode of operation, the wearable device can cause one or more of its light sources to provide one or more visual effects (95). For example, the light sources 76 can be activated and deactivated at particular times so as to provide any of a variety of appropriate visual effects, such as a sequential illumination effect or a blinking effect. Additionally, or alternatively, the light sources 76 can change colors so as to provide one or more color-based effects.

Information describing the one or more detected gestures can be transmitted by the wearable device (96). For example, the wireless transceiver 78*b* can transmit information regarding the gestures that have been detected by the gesture detection unit 78*d* to one or more of the other devices 77.

The technique 90 can continue to repeat steps 93-96 until input is received that indicates that gesture detection should stop (97). For example, the wearable device 75 can continue to perform gesture detection operations until input is received that cause the gesture detection to stop, such as input being received through the user interface 78*a* to change the mode of operation, to power off the wearable device 75, and/or through the absence of input over a period of time (inactivity).

Computer systems described in this document that may be used to implement the systems, techniques, machines, and/or apparatuses can operate as clients and/or servers, and can include one or more of a variety of appropriate computing devices, such as laptops, desktops, workstations, servers, blade servers, mainframes, mobile computing devices (e.g., PDAs, cellular telephones, smartphones, and/or other similar computing devices), computer storage devices (e.g., Universal Serial Bus (USB) flash drives, RFID storage devices, solid state hard drives, hard-disc storage devices), and/or other similar computing devices. For example, USB flash drives may store operating systems and other applications, and can include input/output components, such as wireless transmitters and/or USB connector that may be inserted into a USB port of another computing device.

Such computing devices may include one or more of the following components: processors, memory (e.g., random access memory (RAM) and/or other forms of volatile memory), storage devices (e.g., solid-state hard drive, hard disc drive, and/or other forms of non-volatile memory), high-speed interfaces connecting various components to each other (e.g., connecting one or more processors to memory and/or to high-speed expansion ports), and/or low speed interfaces connecting various components to each other (e.g., connecting one or more processors to a low speed bus and/or storage devices). Such components can be interconnected using various busses, and may be mounted across one or more motherboards that are communicatively connected to each other, or in other appropriate manners. In some implementations, computing devices can include pluralities of the components listed above, including a plurality of processors, a plurality of memories, a plurality of types of memories, a plurality of storage devices, and/or a plurality of buses. A plurality of computing devices can be connected to each other and can coordinate at least a portion of their computing resources to perform one or more operations, such as providing a multi-processor computer system, a computer server system, and/or a cloud-based computer system.

Processors can process instructions for execution within computing devices, including instructions stored in memory and/or on storage devices. Such processing of instructions can cause various operations to be performed, including causing visual, audible, and/or haptic information to be output by one or more input/output devices, such as a display that is configured to output graphical information, such as a graphical user interface (GUI). Processors can be implemented as a chipset of chips that include separate and/or multiple analog and digital processors. Processors may be implemented using any of a number of architectures, such as a CISC (Complex Instruction Set Computers) processor architecture, a RISC (Reduced Instruction Set Computer) processor architecture, and/or a MISC (Minimal Instruction Set Computer) processor architecture. Processors may provide, for example, coordination of other components computing devices, such as control of user interfaces, applications that are run by the devices, and wireless communication by the devices.

Memory can store information within computing devices, including instructions to be executed by one or more processors. Memory can include a volatile memory unit or units, such as synchronous RAM (e.g., double data rate synchronous dynamic random access memory (DDR SDRAM), DDR2 SDRAM, DDR3 SDRAM, DDR4 SDRAM), asynchronous RAM (e.g., fast page mode dynamic RAM (FPM DRAM), extended data out DRAM (EDO DRAM)), graphics RAM (e.g., graphics DDR4 (GDDR4), GDDR5). In some implementations, memory can include a non-volatile memory unit or units (e.g., flash memory). Memory can also be another form of computer-readable medium, such as magnetic and/or optical disks.

Storage devices can be capable of providing mass storage for computing devices and can include a computer-readable medium, such as a floppy disk device, a hard disk device, an optical disk device, a Microdrive, or a tape device, a flash memory or other similar solid state memory device, or an array of devices, including devices in a storage area network or other configurations. Computer program products can be tangibly embodied in an information carrier, such as memory, storage devices, cache memory within a processor, and/or other appropriate computer-readable medium. Computer program products may also contain instructions that, when executed by one or more computing devices, perform one or more methods or techniques, such as those described above.

High speed controllers can manage bandwidth-intensive operations for computing devices, while the low speed controllers can manage lower bandwidth-intensive operations. Such allocation of functions is exemplary only. In some implementations, a high-speed controller is coupled to memory, display 616 (e.g., through a graphics processor or accelerator), and to high-speed expansion ports, which may accept various expansion cards; and a low-speed controller is coupled to one or more storage devices and low-speed expansion ports, which may include various communication ports (e.g., USB, Bluetooth, Ethernet, wireless Ethernet) that may be coupled to one or more input/output devices, such as keyboards, pointing devices (e.g., mouse, touchpad, track ball), printers, scanners, copiers, digital cameras, microphones, displays, haptic devices, and/or networking devices such as switches and/or routers (e.g., through a network adapter).

Displays may include any of a variety of appropriate display devices, such as TFT (Thin-Film-Transistor Liquid Crystal Display) displays, OLED (Organic Light Emitting Diode) displays, touchscreen devices, presence sensing display devices, and/or other appropriate display technology. Displays can be coupled to appropriate circuitry for driving the displays to output graphical and other information to a user.

Expansion memory may also be provided and connected to computing devices through one or more expansion interfaces, which may include, for example, a SIMM (Single In Line Memory Module) card interfaces. Such expansion memory may provide extra storage space for computing devices and/or may store applications or other information that is accessible by computing devices. For example, expansion memory may include instructions to carry out and/or supplement the techniques described above, and/or may include secure information (e.g., expansion memory may include a security module and may be programmed with instructions that permit secure use on a computing device).

Computing devices may communicate wirelessly through one or more communication interfaces, which may include digital signal processing circuitry when appropriate. Communication interfaces may provide for communications under various modes or protocols, such as GSM voice calls, messaging protocols (e.g., SMS, EMS, or MMS messaging), CDMA, TDMA, PDC, WCDMA, CDMA2000, GPRS, 4G protocols (e.g., 4G LTE), and/or other appropriate protocols. Such communication may occur, for example, through one or more radio-frequency transceivers. In addition, short-range communication may occur, such as using a Bluetooth, Wi-Fi, or other such transceivers. In addition, a GPS (Global Positioning System) receiver module may provide additional navigation- and location-related wireless data to computing devices, which may be used as appropriate by applications running on computing devices.

Computing devices may also communicate audibly using one or more audio codecs, which may receive spoken information from a user and convert it to usable digital information. Such audio codecs may additionally generate audible sound for a user, such as through one or more speakers that are part of or connected to a computing device. Such sound may include sound from voice telephone calls, may include recorded sound (e.g., voice messages, music files, etc.), and may also include sound generated by applications operating on computing devices.

Various implementations of the systems, devices, and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications, or code) can include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor.

To provide for interaction with a user, the systems and techniques described here can be implemented on a computer having a display device (e.g., LCD display screen, LED display screen) for displaying information to users, a keyboard, and a pointing device (e.g., a mouse, a trackball, touchscreen) by which the user can provide input to the computer. Other kinds of devices can be used to provide for interaction with a user as well; for example, feedback provided to the user can be any form of sensory feedback (e.g., visual feedback, auditory feedback, and/or tactile feedback); and input from the user can be received in any form, including acoustic, speech, and/or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system can include clients and servers. A client and server are generally remote from each other and typically interact through a communication network. The relationship of client and server arises by virtue of computer programs running on the respective computers and having a client-server relationship to each other.

The above description provides examples of some implementations. Other implementations that are not explicitly described above are also possible, such as implementations based on modifications and/or variations of the features described above. For example, the techniques described above may be implemented in different orders, with the inclusion of one or more additional steps, and/or with the exclusion of one or more of the identified steps. Similarly, the systems, devices, and apparatuses may include one or more additional features, may exclude one or more of the identified features, and/or include the identified features combined in a different way than presented above. Features that are described as singular may be implemented as a plurality of such features. Likewise, features that are described as a plurality may be implemented as singular instances of such features. The drawings are intended to be illustrative and may not precisely depict some implementations. Variations in sizing, placement, shapes, angles, and/or the positioning of features relative to each other are possible.

What is claimed is:

1. A signaling apparatus comprising:

a glove that is configured to be worn on a hand of a user;

a first light source that extends along and is affixed to at least a portion of a lateral side of the glove, the lateral side of the glove corresponding to a lateral side of the user's hand that includes, at least, the user's fifth digit, fifth metacarpal, and ulna bone;

a second light source that extends along and is affixed to at least a portion of an opposite lateral side of the glove, the opposite lateral side of the glove corresponding to an opposite lateral side of the user's hand that includes, at least, the user's radial bone and one or more of: (i) the user's first metacarpal and first digit, and (ii) the user's second metacarpal and second digit; and a palm portion of the glove comprising a material that is different from the first light source and the second light source, wherein light sources on the glove are limited (i) to the first light source and the second light source and (ii) to the lateral side and the opposite lateral side of the glove.

2. The signaling apparatus of claim 1, wherein the first light source comprises a first plurality of light emitting diodes (LEDs) and the second light source comprises a second plurality of LEDs.

3. The signaling apparatus of claim 2, wherein the first plurality of LEDs are arranged in series along the lateral side of the glove and the second plurality of LEDs are arranged in series along the opposite lateral side of the glove.

4. The signaling apparatus of claim 1, wherein the second light source extends along portions of the opposite lateral side of the glove that correspond to, at least, the user's first metacarpal and first digit.

5. The signaling apparatus of claim 4, wherein the second light source further extends along portions of the opposite lateral side of the glove that correspond to, at least, the user's second metacarpal and second digit.

6. The signaling apparatus of claim 1, wherein the second light source extends along portions of the opposite lateral side of the glove that correspond to, at least, the user's second metacarpal and second digit.

7. The signaling apparatus of claim 1, further comprising:

a power source that is affixed to the glove and that is electrically coupled, either directly or indirectly, to the first light source and the second light source.

8. The signaling apparatus of claim 1, wherein the first light source and the second light source emit infrared light.

9. The signaling apparatus of claim 1, further comprising:

one or more first portions of reflective material that are affixed to the glove at one or more first locations that are substantially adjacent to the first light source; and one or more second portions of reflective material that are affixed to the glove at one or more second locations that are substantially adjacent to the second light source.

10. The signaling apparatus of claim 1, further comprising:

a user interface that is affixed to the glove and that is configured (i) to receive user input to control operation of the first light source and the second light source and (ii) to provide output identifying a mode of operation for signaling apparatus.

11. The signaling apparatus of claim 10, wherein the user interface includes one or more of: a display, a touchscreen, buttons, a speaker, a motion sensor, a microphone, and a haptic device.

12. The signaling apparatus of claim 10, wherein the signaling apparatus is configured to operate in a dynamic visual effect mode of operation in which the first light source and the second light source are activated in particular ways so as to provide one or more particular visual effect in response to detected gestures;

the signaling apparatus further comprising:

one or more motion sensors;

a gesture detection unit that is configured to detect gestures that are performed by the user wearing the glove based on movements that are detected by the one or more motion sensors; and a processor that is configured to activate the first light source and the second light source in the particular ways based on the gestures that are identified by the gesture detection unit.

13. The signaling apparatus of claim 10, wherein the signaling apparatus is configured to operate in an information reporting mode of operation in which the signaling apparatus transmits information identifying signals that are being performed by a user wearing the glove to a remote computing or communication device;

the signaling apparatus further comprising:

one or more motion sensors;

a gesture detection unit that is configured to detect gestures that are performed by the user wearing the glove based on movements that are detected by the one or more motion sensors; and a wireless transceiver that is configured to wirelessly transmit to the remote computing or communication device information identifying signals that are being performed by a user wearing the glove based on the gestures that are detected by the gesture detection unit.

14. The signaling apparatus of claim 1, further comprising:

another glove that is configured to be worn on the user's other hand;

a third light source that extends along and is affixed to at least a portion of a lateral side of the other glove, the lateral side of the other glove corresponding to a lateral side of the user's other hand that includes, at least, the user's fifth digit, fifth metacarpal, and ulna bone on the other hand; and a fourth light source that extends along and is affixed to at least a portion of an opposite lateral side of the other glove, the opposite lateral side of the other glove corresponding to an opposite lateral side of the user's other hand that includes, at least, the user's radial bone on the other hand and one or more of: (i) the user's first metacarpal and first digit on the other hand, and (ii) the user's second metacarpal and second digit on the other hand; and another palm portion of the other glove comprising a material that is different from the third light source and the fourth light source, wherein light sources on the other glove are limited (i) to the third light source and the fourth light source and (ii) to the lateral side and the opposite lateral side of the other glove.

15. The signaling apparatus of claim 1, wherein the glove is constructed from one or more of the materials selected from the group consisting of: leather, polyester, neoprene, nitrile, PVC, cotton, polymer-coated cloth, KEVLAR, and NOMEX.

16. An apparatus for conveying signals, the apparatus comprising:

a wearable device that is configured to be worn on at least a portion of a user's arm or hand;

a first light source that extends along and is affixed to at least a portion of a lateral side of the wearable device; and a second light source that extends along and is affixed to at least a portion of an opposite lateral side of the wearable device;

wherein the wearable device comprises a glove;

where in the wearable device comprises a sleeve;

wherein the first light source extends beyond a distal end of the sleeve and terminates at a first loop that is configured to attach to, at least, a fifth digit on the user's hand, and the second light source extends beyond the distal end of the sleeve and terminates at a second loop that is configured to attach to, at least, a first digit of the user's hand;

wherein light sources on the wearable device are limited (i) to the first light source and the second light source and (ii) to the lateral side and the opposite lateral side of the wearable device.

17. The apparatus of claim 16, wherein:

the lateral side of the wearable device corresponds to a lateral side of the user's arm or hand, and the opposite lateral side of the wearable device corresponds to an opposite lateral side of the user's arm or hand.

* * * * *